US009620070B2

(12) United States Patent
Liu et al.

(10) Patent No.: US 9,620,070 B2
(45) Date of Patent: Apr. 11, 2017

(54) IMAGE DISPLAY CONTROLLING METHOD BASED ON INTERPOLATION AND CONTROL DEVICE THEREOF, IMAGE DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Lei Liu, Beijing (CN); Daekeun Yoon, Beijing (CN); Weihao Hu, Beijing (CN); Zongze He, Beijing (CN); Wengang Su, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 27 days.

(21) Appl. No.: 14/429,504

(22) PCT Filed: Jun. 30, 2014

(86) PCT No.: PCT/CN2014/081260
§ 371 (c)(1),
(2) Date: Mar. 19, 2015

(87) PCT Pub. No.: WO2015/113374
PCT Pub. Date: Aug. 6, 2015

(65) Prior Publication Data

US 2016/0005370 A1 Jan. 7, 2016

(30) Foreign Application Priority Data

Jan. 28, 2014 (CN) ..... 2014 1 0042185

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3611* (2013.01);
(Continued)

(58) Field of Classification Search
None
See application file for complete search history.

(56) References Cited

U.S. PATENT DOCUMENTS 6,628,247 B2 * 9/2003 Toffolo ..... G09G 3/007 345/31
2006/0007080 A1 * 1/2006 Yeh ..... G09G 3/36 345/87

(Continued)

FOREIGN PATENT DOCUMENTS

CN 1641727 A 7/2005
CN 101261813 A 9/2008

(Continued)

OTHER PUBLICATIONS

First Chinese Office Action issued Jul. 1,2015; Appln. No. 201410042185.2.

(Continued)

*Primary Examiner* — Antonio Xavier
(74) *Attorney, Agent, or Firm* — Ladas & Parry LLP

(57) ABSTRACT

An image display controlling method and a control device thereof, and an image display device are provided. The method includes: receiving at least one frame of a first image to be displayed by the display; controlling the display to interpolatively display a frame of a second image when a frame number of the received first image displayed continuously by the display is greater than or equal to a preset frame (Continued)

number; wherein the first image is different from the second image. This method can prevent the display to display a still picture for a long time and thereby eliminating after-image.

10 Claims, 5 Drawing Sheets

(52) U.S. Cl.
CPC . *G09G 2310/08* (2013.01); *G09G 2320/0257* (2013.01); *G09G 2320/046* (2013.01); *G09G 2320/10* (2013.01); *G09G 2320/103* (2013.01); *G09G 2340/16* (2013.01)

(56) References Cited

U.S. PATENT DOCUMENTS

2007/0146237 A1* 6/2007 Lee ..... G09G 5/003 345/42
2007/0266345 A1* 11/2007 Cok ..... G09G 3/3216 715/867
2009/0109290 A1* 4/2009 Ye ..... G09G 3/3611 348/155
2009/0179909 A1* 7/2009 Fernandez ..... G09G 5/00 345/581
2010/0085290 A1 4/2010 Culbert et al.
2010/0097307 A1* 4/2010 Chen ..... G09G 3/3611 345/89
2011/0050750 A1 3/2011 Zhao
2012/0147068 A1* 6/2012 Gondo ..... G09G 3/3406 345/690
2014/0043376 A1 2/2014 Zhang et al.

FOREIGN PATENT DOCUMENTS

CN 101996591 A 3/2011
CN 102903348 A 1/2013
CN 102800290 A 11/2013
CN 103778897 A 5/2014
WO 2011034157 A1 3/2011

OTHER PUBLICATIONS

Chinese Notification to Grant issued Jan. 26, 2016; Appln. No. 201410042185.2.
First Chinese Office Action Appln. No. 201410042185.2; Dated Jul. 1, 2015.
International Search Report Appln. No. PCT/CN2014/081260; Dated Oct. 27, 2014.
Written Opinon of the International Searching Authority Appln. No. PCT/CN2014/081260; Dated Oct. 27, 2014.

* cited by examiner

IMAGE DISPLAY CONTROLLING METHOD BASED ON INTERPOLATION AND CONTROL DEVICE THEREOF, IMAGE DISPLAY DEVICE

TECHNICAL FIELD

At least one embodiment of the present invention relates to an image display controlling method, an image display control device and an image display device.

BACKGROUND

Liquid crystal displays (LCDs), as one kind of flat panel display devices, have been applied in the high performance display field more and more due to their features such as small volume, low power consumption, no irradiation and relatively low manufacturing cost.

The display panel of a liquid crystal display includes a top substrate and a bottom substrate with alignment layers thereon respectively, and a liquid crystal layer between the top and bottom substrates. Driven by an external electric field, liquid crystal molecules in the liquid crystal layer rotate, thereby controlling picture display of the liquid crystal display.

SUMMARY

At least one embodiment of the present invention provides an image display controlling method and a control device thereof, and an image display device to prevent the liquid crystal display from displaying a static picture for a long time, thereby eliminating after-images.

One aspect of embodiments of the present invention provides an image display controlling method including: receiving at least one frame of a first image to be displayed by the display; controlling the display to interpolatively display a frame of a second image when a frame number of the received first image displayed continuously by the display is greater than or equal to a preset frame number; wherein the first image is different from the second image.

Another aspect of embodiments of the present invention provides an image display control device including: a receiving unit configured to receive at least one frame of a first image for a display to display; a control unit configured to, where a frame number of the first images displayed continuously by the display received by the receiving unit is greater than or equal to a preset frame number, control the display to interpolatively display a frame of a second image; wherein the first image is different from the second image.

Yet another aspect of embodiments of the present invention provides an image display device including a display and an image display control device, the image display control device including the above-mentioned image display control device.

BRIEF DESCRIPTION OF DRAWINGS

In order to explain the technical solution of embodiments of the present invention more clearly, accompanying drawings of the embodiments will be introduced briefly below. Obviously, the accompanying drawings in the following description only relate to some embodiments of the present invention rather than limiting the present invention.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

The inventors of the present application have noted that, when a liquid crystal display drives a still (static) image for a long time (that is, continuously displays the same image for a long time), (impurity) ions in the liquid crystal layer in the display panel of the liquid crystal display travel toward the top and bottom substrate in the direction of external electric field and accumulate on alignment layers. These aggregated ions will generate an internal electric field. When the display displays the next image, ions accumulated on the alignment layers do not leave the alignment layers immediately, resulting in a residuary DC voltage on both sides of the liquid crystal layer. This DC voltage polarizes liquid crystal molecules such that they are in certain rotation angles and hard to change. This can cause the image displayed by the liquid crystal display to deviate. For example, when the image displayed on the screen is switched from a still image to the next image, the image of the last picture (namely the still image) remains partially on the display panel, resulting in an after-image, which in turn influences the quality of the next image to be displayed by the liquid crystal display.

Contents displayed by a liquid crystal display device may be still pictures such as photos, characters, and may also be dynamic pictures such as videos. For either kind of information, the liquid crystal display device display it by continuously updating images represented on the screen by for example a frequency of 60 frames or 120 frames per second. Accordingly, data (information) for display is also processed continuously to obtain contents of each frame of image. When still pictures are displayed, contents of each frame of image are the same. When dynamic pictures are displayed, contents of consecutive frames of images may vary according to the dynamic degree, which result in consecutive changes due to the visual persistence phenomenon.

Figure 1:
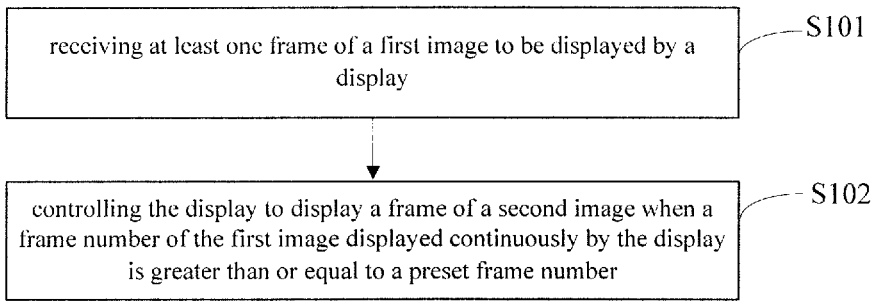
FIG. 1 is a flow chart of an image display controlling method provided in one embodiment of the present invention.

At least one embodiment of the present invention provides an image display controlling method as shown in FIG. 1, which may include: receiving at least one frame of a first image to be displayed by the display; controlling the display to interpolatively display a frame of a second image when the frame number of the first image displayed continuously by the display is greater than or equal to a preset frame number T. Here, the first image is different from the second image.

It is to be noted that the above-mentioned display may refer to a liquid crystal display. When the liquid crystal display displays a still picture for a long time (for example continuously display a first image for a long time), liquid crystal molecules of the liquid crystal display will be acted on by a DC component, polarizing liquid crystal molecules such that they are in a certain rotation angle. When the liquid crystal display displays the next picture, it is very difficult for the polarized liquid crystal molecules to rotate to the desired positions for displaying the next picture immediately, making the next picture to be superimposed at least partially on the last still picture for displaying, hence generating after-images.

Therefore, with the image display controlling method provided in the above-mentioned embodiment of the present invention, it is possible to set a preset frame number T, and the display is controlled to interpolatively display a frame of a second image if the frame number of the first image continuously displayed by the display is greater than or equal to the above-mentioned preset frame number T, that is, the picture displayed by the display in a preset frame number T has not changed (namely a still picture). Since the second image is different from the first image, it is possible to avoid after-image generated because the liquid crystal display displays still pictures for a long time. In this way, in the process that the liquid crystal display displays a still first image, when the frame number of the displayed first image is greater than or equal to a preset frame number T, it is possible to insert a second image that is different from the first image, and it is therefore possible to increase the number of pictures and reduce the time period during which the liquid crystal display continuously display the same still picture.

It is to be noted that the case where the second image is different from the first image may involve various conditions. For example, each pixel of the second image has a gray scale value different from that of each pixel of the first image. Alternatively, as another example, some pixels of the second image have different gray scale values from that of some pixels of the first image. Alternatively, as yet another example, all pixels of the second image have gray scale values of fixed values, for example, 127.

Some embodiments of the present invention provide an image display controlling method including: receiving at least one frame of a first image to be displayed by the display; controlling the display to interpolatively display a frame of a second image when the frame number of the first image displayed continuously by the display is greater than or equal to a preset frame number T. The first image is different from the second image. In this way, it is possible to prevent the liquid crystal display from displaying still pictures for a long time, enabling voltages across liquid crystal molecules to be in a condition of varying multiple states, thereby avoiding after-image.

Figure 2:
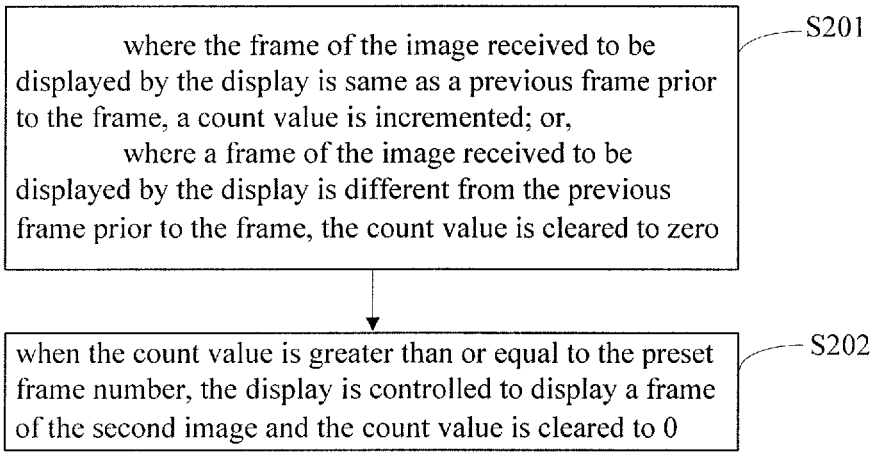
FIG. 2 is a flow chart of an image display controlling method provided in another embodiment of the present invention.

In at least one embodiment of the present invention, when the frame number of the first image continuously displayed by the display is greater than or equal to a preset frame number T, controlling the display to interpolatively display a frame of a second image may include steps shown in FIG. 2.

In S201, when a frame of a first image received to be displayed by the display is the same as the previous frame prior to the frame, the count value is incremented. Alternatively, when a frame of a first image received to be displayed by the display is different from the previous frame prior to the frame, the count value is cleared to zero.

It is to be noted that the two determination processes in step S201 are not necessarily carried out in any specific order, which function to determine whether the first image displayed by the display changes. When the first image displayed by the display dose not change, that is, a still picture is displayed, the count value is incremented; and when the first image displayed by the display changes, that is, a dynamic picture is displayed, the count value is cleared.

In S202, when the count value is greater than or equal to a preset frame number T, the display is controlled to interpolatively display a frame of a second image and the count value is cleared to zero.

In this way, the duration for which the display displays the first image is controlled by counting a value. When the count value indicates that the frame number of the first image displayed continuously by the display is greater than or equal to a preset frame number T, the display is controlled to interpolatively display a frame of a second image. This can avoid after-image generated because the display displays a still picture for a long time.

Figure 3:
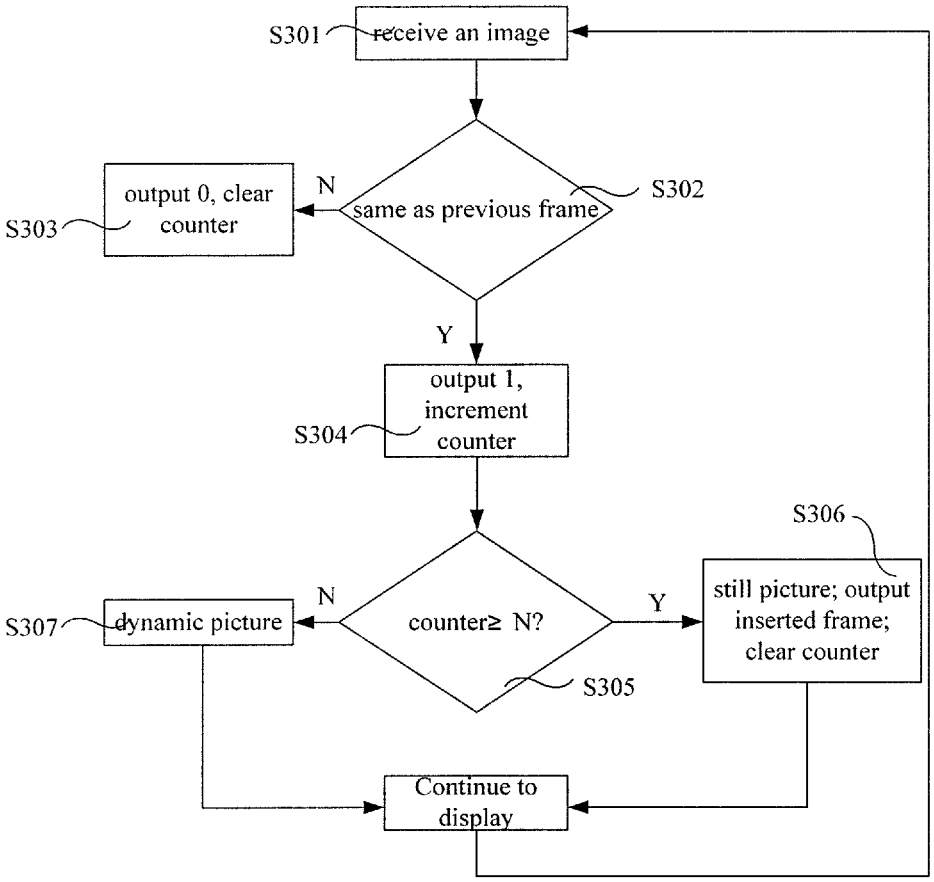
FIG. 3 is a flow chart of an image display controlling method provided in yet another embodiment of the present invention.

The image display controlling method provided in at least one embodiment of the present invention will be explained below with the flow chart shown in FIG. 3 as an example.

In S301, an image is received, that is, at least one frame of first image is received to be displayed by the display.

In S302, it is determined whether the first image to be displayed by the display is the same as the previous frame of image, that is, whether the image displayed by the display change.

In S303, when the received frame of the first image to be displayed by the display is different from the previous frame of first image, 0 is output to the counter and the counter is cleared to 0.

In 5304, when a frame of a first image received to be displayed by the display is the same as the previous frame of image prior to this frame of image, one (1) is output to the counter and the counter is incremented by one (1).

In S305, it is determined whether the value in the above-mentioned counter is greater than or equal to N (wherein n corresponds to the above-mentioned preset frame number T).

In S306, when the determination result of step S305 is that the value in the counter is greater than or equal to N, indicating that the display is displaying a still picture (that is, the display continuously display the same first image in the above-mentioned time), it is possible to output an inserted frame (that is, output a frame of a second image), and at the same time the counter is cleared, and then the display go on displaying the picture that is required to be displayed normally. The picture required to be displayed normally may be still the first image.

In S307, when the determination result of step S305 is that the value in the counter is smaller than N, indicating that the display is displaying a dynamic image (that is, the display does not continuously display a first image in the above-mentioned time), the display can go on displaying the picture required to be displayed normally.

In at least one embodiment of the present invention, before controlling the display to interpolatively display a frame of a second image, the above-mentioned image display controlling method may be further carried out as follows.

For example, the second image is obtained according to the first image, or the second image may be the inserted image derived from the first image. For example, while obtaining the second image from the first image, transformation may be carried out pixel by pixel according to the first image, or the first image is divided into a group of areas of the same size, and then transformed area by area. In this way, since the interpolatively displayed second image is derived from the first image, it is possible to reduce the difference between the first image and the second image. This can reduce the flickering phenomenon of the displayed picture observed by human eyes while eliminating after-image, thereby enhancing the display effect of the display device.

Figure 4:
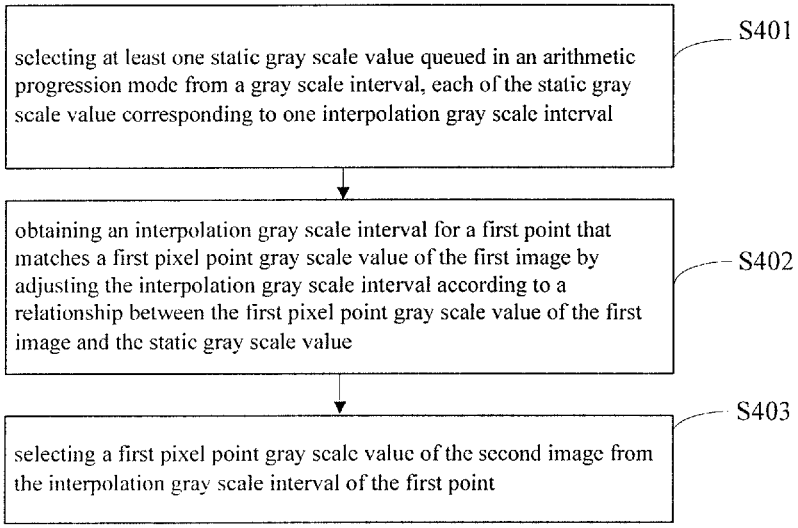
FIG. 4 is a flow chart of an image display controlling method provided in yet another embodiment of the present invention.

In at least one embodiment of the present invention, as shown in FIG. 4, obtaining the second image according to the first image may include:

S401, taking at least one static gray scale value queued as for example an arithmetic progression from the gray scale interval, with each static gray scale value corresponding to one interpolation gray scale interval.

It is to be noted that the above-mentioned gray scale interval refers to for example a gray scale value range of 0~255. However, the present invention is not limited thereto.

In at least one embodiment of the present invention, taking at least one static gray scale value queued in an arithmetic progression mode from the gray scale interval may include: setting a stepping value A and incrementing the taken static gray scale values in turn by one stepping value A to thereby constitute one arithmetic progression. Those skilled in the art can set the above-mentioned stepping value A according to production requirements. For example, it is possible to set the stepping value A as 1. Then, the at least one static gray scale value queued in an arithmetic progression mode taken from the gray scale interval may include 256 static gray scale values, namely 0, 1, 2, . . . 50, 51, 52, . . . 101, 102, . . . 254, 255.

Alternatively, considering the storage capacity of register and costs in the data processing process, the above-mentioned stepping value may be set to 8. In this way, requirements on the storage capacity of register may be reduced, thereby reducing the production costs. For example, when the stepping value A is set to 8, the at least one static gray scale value queued in an arithmetic progression mode taken from the gray scale interval may be as shown in Table 1. Each static gray scale value in Table 1 corresponds to one interpolation gray scale interval. Therefore, in the interpolation process, for different static gray scale values, it is possible to select one value from the interpolation gray scale interval corresponding to it to interpolate the picture with the above-mentioned static gray scale value.

TABLE 1

| Static gray scale value | 0 | 8 | 16 | . . . | 0 + n * A | . . . | 255 |
|---|---|---|---|---|---|---|---|
| Interpolation gray scale interval | a | b, c | d, e | . . . | f, g | . . . | h |

For example, the static gray scale value 8 corresponds to an interpolation gray scale interval [b, c]. Specific values of the lower limit b and the upper limit c of the interpolation gray scale interval may be adjusted while satisfying the condition that the displayed picture observed by human eyes does not flicker. For example, b is set to 5, and c is set to 11. In the process of interpolating the previous frame of displayed image (first image) having pixels with static gray scale value 8, the display displays the interpolated frame of image (second image). If human eyes observe flickering when pixel values corresponding to static gray scale value 8 in the displayed interpolated image (second image) are 5 or 11, values for b and c may be adjusted continuously. When b is adjusted to 6 and c is adjusted to 10, human eyes do not observe any flickering when the display is displaying interpolated image (second image). Then b may be set to 6, and c may be set to 10; that is, the static gray scale value 8 corresponds to an interpolation gray scale interval [6, 10].

In a similar way, the interpolation gray scale intervals corresponding to other static gray scale values in Table 1 may also be set by the above-mentioned method. Furthermore, for the static gray scale value 0, its corresponding interpolation gray scale interval may be a specific value a ($a \geq 0$). The specific value for value a may also be adjusted in case that the displayed picture observed by human eyes does not flicker. For example, when a is set to 6, human eyes observe flickering, while when a is set to 5, human eyes do not observe flickering. Therefore a may be set to 5. In a similar way, the interpolation gray scale interval h corresponding to static gray scale value 255 may be set.

In S402, for example, a first point interpolation gray scale interval that matches the gray scale value of the first pixel point in the first image is obtained according to the relationship between the gray scale value of the first pixel point of the first image and the static gray scale value, and the interpolation gray scale interval corresponding to the static gray scale value.

It is to be noted that the first pixel point in the above-mentioned first pixel point gray scale value may refer to any pixel point in the first image, rather than being limited to any particular pixel in the first image. The relationship between the first pixel point gray scale value of the first image and the static gray scale value may include: the first pixel point gray scale value of the first image corresponding to the static gray scale value; or the first pixel point gray scale value of the first image not corresponding to the static gray scale value.

In at least one embodiment of the present invention, when the first pixel point gray scale value of the first image corresponds to the static gray scale value, the interpolation gray scale interval for the first point has an upper limit and a lower limit equal to those of the interpolation gray scale interval respectively. In one example, when the first pixel point gray scale value of the first image may correspond to the static gray scale value in Table 1, for example, the first pixel point gray scale value of the first image is 8. Therefore, it is possible to obtain an interpolation gray scale interval for the first point [b, c] that matches the first pixel point gray scale value 8 of the first image. When the first pixel point gray scale value of the first image is other values and may correspond to the static gray scale value in Table 1, it is possible to obtain the interpolation gray scale interval for the first point that matches the first pixel point gray scale value of the first image by the above-mentioned method, which will not be described in detail herein.

In at least one embodiment of the present invention, when the first pixel point gray scale value of the first image does not correspond to the static gray scale value, the interpolation gray scale interval for the first point has an upper limit and a lower limit that are obtained by adjusting the interpolation gray scale interval according to the value relationship between the first pixel point gray scale value of the first image and the static gray scale value. When the first pixel point gray scale value of the first image fails to correspond to the static gray scale value in Table 1, the interpolation gray scale interval may be adjusted accordingly through the value relationship. For example, when the first pixel point gray scale value of the first image is 7, it fails to correspond to the static gray scale value in Table 1. In such a case, the interpolation gray scale interval for the first point that matches the first pixel point gray scale value of the first image may be obtained by for example the following methods.

First Method

When the above-mentioned numerical relationship is D, the upper and lower limits of the interpolation gray scale interval for the first point may be obtained by subtracting D from the upper and lower limits of the interpolation gray scale interval, where D is the difference obtained by subtracting the first pixel point gray scale value of the first image from the static gray scale value that is closest to the first pixel point gray scale value of the first image. Since the first pixel point gray scale value, 7, of the first image is closest to the static gray scale value, 8, the difference D between the static gray scale value, 8, and the first pixel point gray scale value of the first image may be calculated as 8−7=1. Therefore, it is possible to subtract the above-mentioned difference D from both the upper and lower limits of the interpolation gray scale interval [b, c] corresponding to the static gray scale value 8 (for example, b set to 6, c set to 10) to obtain the interpolation gray scale interval [5, 9] for the first point that matches the first pixel point gray scale value, 7, of the first image.

Second Method

When the above-mentioned numerical relationship is R, the upper and lower limits of the interpolation gray scale interval for the first point may be obtained by dividing the upper and lower limits of the interpolation gray scale interval by R and rounding off the result, where R is the ratio obtained by dividing the static gray scale value that is closest to the first pixel point gray scale value of the first image by the first pixel point gray scale value of the first image. Since the first pixel point gray scale value, 7, of the first image is closest to the static gray scale value, 8, the ratio R between the static gray scale value 8 and the first pixel point gray scale value of the first image may be calculated as 8/7≈1.173. Therefore, it is possible to divide the lower limit, 6, of the interpolation gray scale interval [b, c] corresponding to the static gray scale value, 8, (for example, b set to 6, c set to 10) by the above-mentioned ratio R to obtain 6/1.173≈5.115, and round off the result to get 5; and divide the upper limit, 10, by the above-mentioned ratio R to obtain 10/1.173≈8.525 and round off the result to get an integer 9; thereby obtaining the interpolation gray scale interval [5, 9] for the first point that matches the first pixel point gray scale value, 7, of the first image.

Of course, both the above-mentioned methods are described with the first pixel point gray scale value of 7 of the first image as an example. When the first pixel point gray scale value of the first image is other values and fails to correspond to the static gray scale value in Table 1, it is possible to obtain the interpolation gray scale interval for the first point that matches the first pixel point gray scale value of the first image by the above-mentioned method, which will not be described in detail herein.

In addition, the above-mentioned numerical relationship is not limited to the difference D obtained by subtracting the first pixel point gray scale value of the first image from the static gray scale value closest to the first pixel point gray scale value of the first image or the ratio R obtained by dividing the static gray scale value closest to the first pixel point gray scale value of the first image by the first pixel point gray scale value of the first image.

In S403, the first pixel point gray scale value of the second image is selected from the interpolation gray scale interval for the first point.

In at least one embodiment of the present invention, when the first pixel point gray scale value of the first image may correspond to the static gray scale value in Table 1, for example, the first pixel point gray scale value of the first image is 8, it is possible to obtain the interpolation gray scale interval [b, c] for the first point that matches the first pixel point gray scale value, 8, of the first image (for example, b set to 6, c set to 10). Therefore, it is possible to select the first pixel point gray scale value of the second image, for example, 7, from the above-mentioned interpolation gray scale interval [6, 10] for the first point.

When the first pixel point gray scale value of the first image fails to correspond to the static gray scale value in Table 1, for example, the first pixel point gray scale value of the first image is 7. By adjusting the interpolation gray scale interval corresponding to the static gray scale value by the above-mentioned numerical relationship, for example, by the above-mentioned method I or method II, the interpolation gray scale interval [5, 9] for the first point that matches the first pixel point gray scale value of the first image is obtained. Therefore, it is possible to select the first pixel point gray scale value of the second image, for example, 8, from the above-mentioned interpolation gray scale interval [5, 9] for the first point.

In this way, it is possible to obtain the second image according to the first image in the above-mentioned way. Each pixel of the second image has its gray scale value selected from one interpolation gray scale interval while the interpolation gray scale interval is set with the precondition of reducing or eliminating the display flickering phenomenon. Therefore, when the frame number of the first image displayed continuously by the display is greater than or equal to a preset frame number, in the process of controlling the display to interpolatively display a frame of a second image, some embodiments of the present invention not only can eliminate after-image of the liquid crystal display, but also can avoid display flickering caused by displaying the inserted frames.

In some embodiments of the present invention, the above-mentioned static gray scale value may be an intermediate value of the interpolation gray scale interval corresponding to the static gray scale value. That is, the upper limit and the lower limit of the interpolation gray scale interval corresponding to the above-mentioned static gray scale value are symmetric about the static gray scale value.

For example, when setting the upper limit c and the lower limit b of the interpolation gray scale interval [b, c] corresponding to the static gray scale value, 8, the upper limit c and the lower limit b are adjusted with the precondition of reducing or avoiding display flickering, and make the static gray scale value, 8, to be the intermediate value of the interpolation gray scale interval [b, c]. For example, when the upper limit c is 10, and the lower limit b is 5, they constitute the interpolation gray scale interval [5, 10]. When selecting the pixel gray scale value of the second image from the interpolation gray scale interval [5, 10], human eyes are unlikely to observe flickering when displaying inserted frames with the above-mentioned second image. However, the static gray scale value of 8 is not the intermediate value of the interpolation gray scale interval [5, 10], therefore it is possible to set the lower limit b to 6, thereby obtaining an interpolation gray scale interval [6, 10] with an upper limit and a lower limit symmetric about the static gray scale value. In this way, it is possible to reduce the range of the interpolation gray scale interval [b, c] to obtain a reduced difference between the values in the interpolation gray scale interval [b, c] and the static gray scale value of 8 correspondent to the interpolation gray scale interval [b, c]. It is possible to make the value selected for the pixels of the second image in the interpolation gray scale interval [b, c] that matches the first image closer to the static gray scale value, thereby better avoid display flickering.

The following methods may be used in selecting the gray scale value of the pixel of the second image (first pixel point) from the above-mentioned interpolation gray scale interval with the upper limit and the lower limit symmetric about the static gray scale value (first interpolation gray scale interval).

Figure 5:
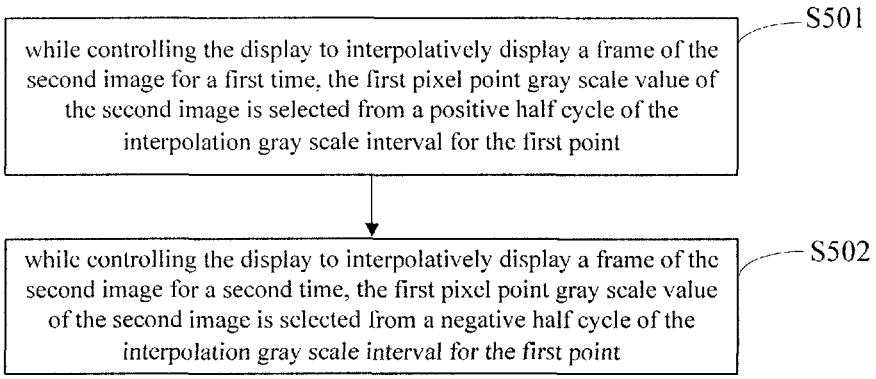
FIG. 5 is a flow chart of an image display controlling method provided in yet another embodiment of the present invention.

Method I, shown in FIG. 5:

In S501, while controlling the display to interpolatively display a frame of a second image for the first time, the first pixel point gray scale value of the second image is selected from the positive half cycle of the interpolation gray scale interval for the first point.

For example, in Table 1, for the interpolation gray scale interval [d, e], corresponding to the static gray scale value 16, when d is 12 and e is 20, the positive half cycle of the interpolation gray scale interval [d, e] is [17, 20].

In S502, while controlling the display to interpolatively display a frame of the second image for the second time, the first pixel point gray scale value of the second image is selected from the negative half cycle of the interpolation gray scale interval for the first point.

For example, in Table 1, for the interpolation gray scale interval [d, e], corresponding to the static gray scale value 16, when d is 12 and e is 20, the negative half cycle of the interpolation gray scale interval [d, e] is [12, 15].

The first pixel point gray scale value obtained from the positive half cycle and the first pixel point gray scale value obtained from the negative half cycle are symmetric about the intermediate value of the interpolation gray scale interval for the first point. For example, the first pixel point gray scale value obtained from the positive half cycle [17, 20] is 18; and the first pixel point gray scale value obtained from the negative half cycle [12, 15] is 14.

Figure 6:
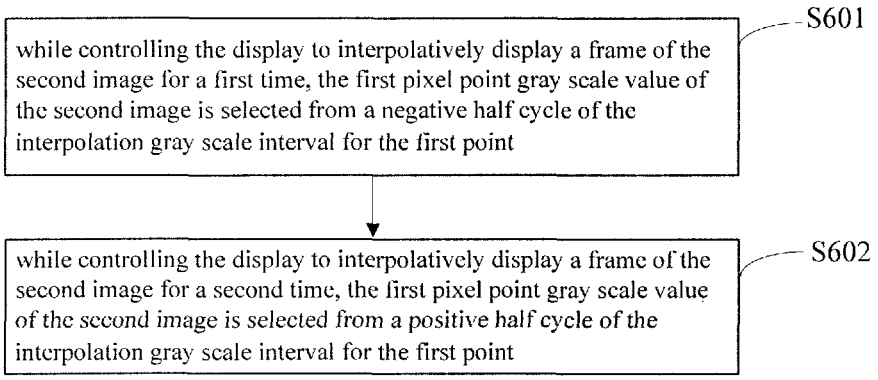
FIG. 6 is a flow chart of an image display controlling method provided in yet another embodiment of the present invention.

Method II, shown in FIG. 6:

In S601, while controlling the display to interpolatively display a frame of a second image for the first time, the first pixel point gray scale value of the second image is selected from the negative half cycle of the interpolation gray scale interval for the first point.

For example, in Table 1, for the interpolation gray scale interval [d, e], corresponding to the static gray scale value 16, when d is 12 and e is 20, the negative half cycle of the interpolation gray scale interval [d, e] is [12, 15].

In S602, while controlling the display to interpolatively display a frame of a second image for the second time, the first pixel point gray scale value of the second image is selected from the positive half cycle of the interpolation gray scale interval for the first point.

For example, in Table 1, for the interpolation gray scale interval [d, e], corresponding to the static gray scale value 16, when d is 12 and e is 20, the positive half cycle of the interpolation gray scale interval [d, e] is [17, 20].

The first pixel point gray scale value 14 obtained from the negative half cycle [12, 15] and the first pixel point gray scale value obtained from the positive half cycle [17, 20] are symmetric about the intermediate value 16 of the interpolation gray scale interval for the first point.

Figure 7:
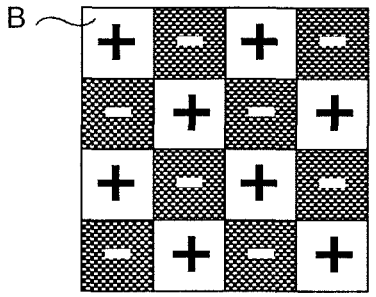
FIG. 7 is a displayed image provided in one embodiment of the present invention.
Figure 8:
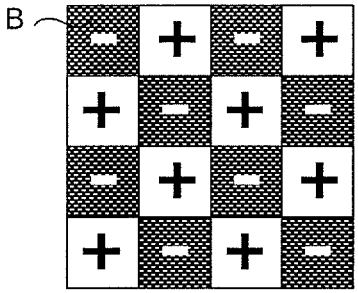
FIG. 8 is a displayed image provided in another embodiment of the present invention.

In this way, the second image of the inserted frame for the odd numbered times is shown in FIG. 7, in which its first pixel point, for example, the pixel B at the top left corner has a gray scale value selected from the positive half cycle [17, 20] of the first interpolation gray scale interval [12, 20] that matches the first image; and the second image of the inserted frame for the even numbered times is shown in FIG. 8, in which its first pixel point B has a gray scale value selected from the negative half cycle [12, 15] of the first interpolation gray scale interval [12, 20] that matches the first image, and the value, 18, of the first pixel point B for the odd numbered times and the value, 14, of the first pixel point B for the even numbered times are symmetric about the static gray scale value, 16, corresponding to the first interpolation gray scale interval [12, 20]. In FIGS. 7 and 8, each cell represents one pixel, "+" represents selection in the positive half cycle of the interpolation gray scale interval, and "−" represents selection in the negative half cycle of the interpolation gray scale interval.

In this way, in the process of interpolatively displaying the second images for two times, namely odd numbered and even numbered times in turn, although the second images displayed interpolatively for the two times are different, human eyes can hardly observe display flickering in the two interpolation frames since the first pixel point gray scale values of the second images in the two display operations have the same differences with respect to the static gray scale value corresponding to the first interpolation gray scale interval. Therefore, the above-mentioned method can mitigate or eliminate after-image by increasing the number of dynamic images, and at the same time can reduce flickering in display observed by human eyes, thereby improving the display effect of the display device.

Of course, the above description explains the interpolation display process only with respect to the first pixel gray scale value of the first image corresponding to the static gray scale value, 16, as an example, other first pixel gray scale values will not be cited herein one by one, but should all belong to the scope of the present invention.

Figure 9:
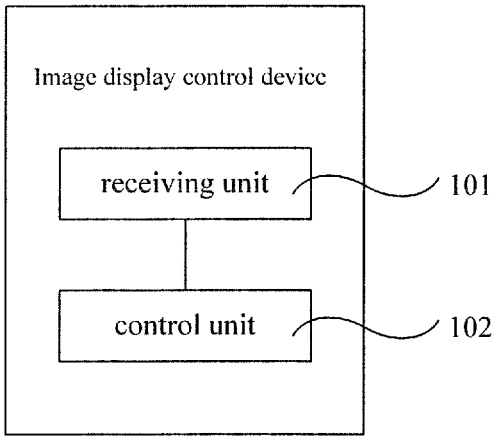
FIG. 9 is a structural representation of an image display control device provided in one embodiment of the present invention.

At least one embodiment of the present invention provides an image display control device as shown in FIG. 9, including a receiving unit 101 and a control unit 102. The receiving unit 101 is configured to receive at least one frame of a first image for the display to display. The control unit 102 is configured to, when the frame number of the first image displayed continuously by the display is greater than or equal to a preset frame number T, control the display to interpolatively display a frame of a second image. The first image is different from the second image.

It is to be noted that the above-mentioned display may refer to a liquid crystal display. When the liquid crystal display displays a still picture for a long time (for example continuously display a first image for a long time), a DC component might exist on the liquid crystal layer of the liquid crystal display to polarize the liquid crystal molecules such that they are in a certain rotation angle and hard to change. Therefore, when the liquid crystal display displays the next picture, the polarized liquid crystal molecules are hard to rotate, resulting in superposition of this picture on the previous still picture to be displayed, thereby generating an after-image.

Therefore, with the image display control device provided in the embodiment of the present invention, it is possible to set a preset frame number T by the control unit 102, and the control unit 102 controls the display to interpolatively display a frame of a second image if the frame number of the first image continuously displayed by the display received by the receiving unit 101 is greater than or equal to the above-mentioned preset frame number T, that is, the picture displayed by the display in a preset frame number T has not changed. Since the second image is different from the first image, it is possible to avoid after-image generated because the liquid crystal display displays still pictures for a long time. In this way, in the process that the liquid crystal display displays a still first image, when the frame number of the displayed first image is greater than or equal to a preset frame number T, it is possible to insert a second image that is different from the first image, and it is therefore possible to reduce the time period during which the liquid crystal display displays the same still picture.

It is to be noted that the second image is different from the first image may include for example: each pixel of the second image has a gray scale value different from that of each pixel of the first image; or as another example, some pixels of the second image have gray scale values different from that of some pixels of the first image; or as yet another example, all pixels of the second image have gray scale values as a fixed value, for example, the second image may be an image having all pixels with a gray scale value of 127.

At least one embodiment of the present invention provides an image display control device including: a receiving unit for receiving at least one frame of a first image to be displayed by the display; and a control unit for, when the frame number of the first image continuously displayed by the display is greater than or equal to a preset frame number, controlling the display to interpolatively display a frame of a second image. The first image is different from the second image. In this way, it is possible to prevent the liquid crystal display from displaying still pictures for a long time, enabling voltages across liquid crystal molecules to be in a condition of varying multiple states, thereby avoiding after-image.

Figure 10:
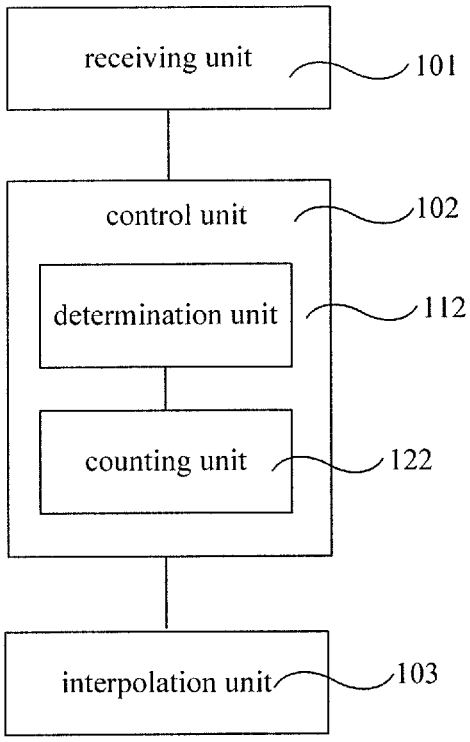
FIG. 10 is a structural representation of an image display control device provided in another embodiment of the present invention.

In some embodiments of the present invention, as shown in FIG. 10, the control unit 102 may include: a determination module 112 for determining whether a frame of image displayed by the display is the same as the previous image prior to this frame of image; a counting module 122 for incrementing the count value when the receive frame of image to be displayed by the display is the same as the previous frame of image prior to this frame of image, or clearing the count value to 0 when the receive frame of image to be displayed by the display is different from the previous frame of image prior to this frame of image. The counting module 122 may be a counter.

In this way, the duration for which the display displays the first image is controlled by the counting module 122, and when the count value of the counting module 122 indicates that the frame number of the first image displayed continuously by the display is greater than or equal to a preset frame number T, the control unit 102 controls the display to interpolatively display a frame of a second image. This can avoid after-image generated because the display displays a still picture for a long time.

In some embodiments of the present invention, the image display control device may further include: an interpolation unit 103 for obtaining the second image according to the first image or deriving the second image from the interpolation image of the first image.

In this way, since the interpolatively displayed second image is derived from the first image, the above-mentioned interpolation unit 103 may reduce the difference between the first image and the second image, and therefore can reduce flickering observed by human eyes.

One of ordinary skill in the art can understand: all or partial steps in the method according to the above-mentioned embodiments may be implemented by hardware related to program instructions that may be stored in any computer readable storage medium, which carries out the method steps included in the above-mentioned embodiments while being executed; while the aforementioned storage medium includes various media that can store program codes such as ROMs, RAMs, disks or optical disks.

Figure 11:
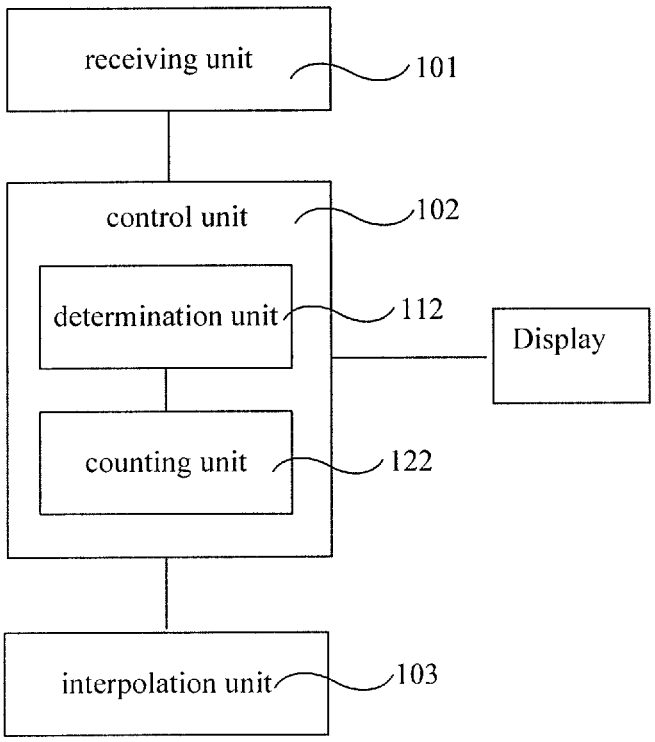
FIG. 11 is a structural representation of an image display device provided in one embodiment of the present invention.

At least one embodiment of the present invention provides an image display device including a display and an image display control device. As shown in FIG. 11, the image display control device includes any of the above-mentioned image display control devices.

It is to be noted that the above-mentioned display may refer to a liquid crystal display, but is not limited thereto.

The image display device provided in the embodiment of the present invention may be any product or component with display function, such as a cell phone, a flat panel computer, a TV set, a display, a notebook computer, a digital picture frame, and a navigator. The above-mentioned embodiments may be referred to for implementations of the display device and repetitions will not be described any more herein.

The image display controlling method and the control device thereof, and the image display device provided in embodiments of the present invention are only described with respect to a liquid crystal display as an example. However, one skilled in the art can understand that the technical proposal of the present invention is not limited to liquid crystal displays, but applicalbe to any scenarios in which, by setting a preset frame number T, it is possible to control the display to interpolatively display a frame of a second image when the frame number of the first image continuously displayed by the display is greater than or equal to the above-mentioned preset frame number T.

What have been described above are only some embodiments. However, the scope of the present invention is not limited thereto. One skilled in the art can easily contemplate variations or substitutions within the technical scope disclosed by the present invention, which should all be covered in the scope of the present invention. Therefore, the scope of the present invention should be defined by the protection scope of the claims.

The present application claims priority of a China patent application No. 201410042185.2 filed on Jan. 28, 2014, which is incorporated in its entirety herein by reference as part of the present application.

The invention claimed is:

1. An image display controlling method comprising:

receiving at least one frame of a first image to be displayed by a display;

controlling the display to interpolatively display a frame of a second image when a frame number of the received first image displayed continuously by the display is greater than or equal to a preset frame number; before the controlling the display to interpolatively display a frame of a second image, obtaining the second image according to the first image, wherein the first image is different from the second image and the second image is an interpolation image of the first image;

wherein, controlling the display to interpolatively display a frame of a second image comprises:

where the frame of the first image received to be displayed by the display is same as a previous frame prior to the frame, a count value is incremented; or, where a frame of the first image received to be displayed by the display is different from the previous frame prior to the frame, the count value is cleared to zero;

where the count value is greater than or equal to the preset frame number, the display is controlled to display a frame of the second image and the count value is cleared to 0, wherein obtaining the second image according to the first image comprises:

selecting at least one static gray scale value queued in an arithmetic progression mode from a gray scale interval, each static gray scale value corresponding to one interpolation gray scale interval;

adjusting the interpolation gray scale interval to obtain an interpolation gray scale interval for a first point that matches a first pixel point gray scale value of the first image according to a relationship between the first pixel gray scale value of the first image and the static gray scale value; and selecting a first pixel point gray scale value of the second image from the interpolation gray scale interval of the first point.

2. The image display controlling method of claim 1, wherein the relationship between the first pixel point gray scale value of the first image and the static gray scale value comprises:

the first pixel point gray scale value of the first image corresponds to the static gray scale value; or the first pixel point gray scale value of the first image does not correspond to the static gray scale value.

3. The image display controlling method of claim 2, wherein where the first pixel point gray scale value of the first image corresponds to the static gray scale value, the interpolation gray scale interval for the first point has an upper limit and a lower limit equal to that of the interpolation gray scale interval respectively.

4. The image display controlling method of claim 2, wherein where the first pixel point gray scale value of the first image does not correspond to the static gray scale value, the interpolation gray scale interval for the first point has an upper limit and a lower limit that are obtained by adjusting the interpolation gray scale interval according to a numerical relationship between the first pixel point gray scale value of the first image and the static gray scale value.

5. The image display controlling method of claim 4, wherein where the numerical relationship is D, the upper and lower limits of the interpolation gray scale interval of the first point are obtained by subtracting D from the upper and lower limits of the interpolation gray scale interval respectively, wherein D is a difference obtained by subtracting the first pixel point gray scale value of the first image from the static gray scale value closest to the first pixel point gray scale value of the first image.

6. The image display controlling method of claim 4, wherein where the numerical relationship is R, the upper and lower limits of the interpolation gray scale interval of the first point are obtained by dividing the upper and lower limits of the interpolation gray scale interval by R respectively and rounding off results, wherein R is a ratio obtained by dividing the static gray scale value closest to the first pixel point gray scale value of the first image by the first pixel point gray scale value of the first image.

7. The image display controlling method of claim 1, wherein the static gray scale value is an intermediate value of the interpolation gray scale interval corresponding to the static gray scale value.

8. The display control method of claim 7, wherein obtaining the second image according to the first image comprises:

while controlling the display to interpolatively display a frame of the second image for a first time, selecting the first pixel point gray scale value of the second image from a positive half cycle of the interpolation gray scale interval for the first point;

while controlling the display to interpolatively display a frame of the second image for a second time, selecting the first pixel point gray scale value of the second image from a negative half cycle of the interpolation gray scale interval for the first point;

wherein the first pixel point gray scale value obtained from the positive half cycle and the first pixel point gray scale value obtained from the negative half cycle are symmetric about an intermediate value of the interpolation gray scale interval for the first point.

9. The image display control method of claim 7, wherein obtaining the second image according to the first image comprises:

while controlling the display to interpolatively display a frame of the second image for a first time, selecting the first pixel point gray scale value of the second image from a negative half cycle of the interpolation gray scale interval for the first point;

while controlling the display to interpolatively display a frame of the second image for a second time, selecting the first pixel point gray scale value of the second image from a positive half cycle of the interpolation gray scale interval for the first point;

wherein the first pixel point gray scale value obtained from the negative half cycle and the first pixel point gray scale value obtained from the positive half cycle are symmetric about an intermediate value of the interpolation gray scale interval for the first point.

10. An image display control device, comprising:

a processor;

a display connected to the processor, a memory that stores a computer program instruction;

wherein, when the computer program instruction is run by the processor, operations to be performed comprise:

receiving at least one frame of a first image from the display to display;

where a frame number of the first image displayed continuously by the display is greater than or equal to a preset frame number, controlling the display to interpolatively display a frame of a second image;

before the controlling the display to interpolatively display a frame of a second image, obtaining the second image according to the first image, wherein the first image is different from the second image and the second image is an interpolation image of the first image;

wherein, controlling the display to interpolatively display a frame of a second image comprises:

determining whether a frame of the image displayed by the display is same as a previous frame prior to the frame; and incrementing a count value where the frame of the image received to be displayed by the display is the same as the previous frame prior to the frame, or clearing the count value to 0 when the frame of the image received to be displayed by the display is different from the previous frame prior to the frame; wherein obtaining the second image according to the first image comprises:

selecting at least one static gray scale value queued in an arithmetic progression mode from a gray scale interval, each static gray scale value corresponding to one interpolation gray scale interval;

adjusting the interpolation gray scale interval to obtain an interpolation gray scale interval for a first point that matches a first pixel point gray scale value of the first image according to a relationship between the first pixel point gray scale value of the first image and the static gray scale value; and selecting a first pixel gray scale value of the second image from the interpolation gray scale interval of the first point.

* * * * *